US011073788B2

(12) United States Patent
Oka et al.

(10) Patent No.: US 11,073,788 B2
(45) Date of Patent: Jul. 27, 2021

(54) PROCESS CARTRIDGE PROVIDING FIXATION LAYER TO DEVELOPER ON IMAGE BEARING MEMBER AND IMAGE FORMING APPARATUS

(71) Applicant: CANON KABUSHIKI KAISHA, Tokyo (JP)

(72) Inventors: Takuya Oka, Yokohama (JP); Yoshihiro Mitsui, Numazu (JP); Yasukazu Ikami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/430,029

(22) Filed: Jun. 3, 2019

(65) Prior Publication Data

US 2019/0377300 A1 Dec. 12, 2019

(30) Foreign Application Priority Data

Jun. 8, 2018 (JP) ..... JP2018-110475

(51) Int. Cl.
*G03G 21/18* (2006.01)
*G03G 21/00* (2006.01)

(52) U.S. Cl.
CPC ..... *G03G 21/1814* (2013.01); *G03G 21/0011* (2013.01)

(58) Field of Classification Search
CPC ..... G03G 21/1814; G03G 21/0011; G03G 15/5008; G03G 9/00
See application file for complete search history.

(56) References Cited

U.S. PATENT DOCUMENTS

| | | | | |
|---|---|---|---|---|
| 5,628,043 | A * | 5/1997 | Ikeda et al. | |
| 9,164,410 | B2 * | 10/2015 | Kmiecik-Lawrynowicz et al. | |
| 2004/0223792 | A1 * | 11/2004 | Aoki et al. | |
| 2008/0081278 | A1 * | 4/2008 | Matsumoto etal. | |
| 2012/0148314 | A1 * | 6/2012 | Park et al. | |
| 2017/0285546 | A1 * | 10/2017 | Saito | G03G 15/5062 |

FOREIGN PATENT DOCUMENTS

| | | | |
|---|---|---|---|
| JP | 09218573 | A * | 8/1997 |
| JP | 2001305780 | A * | 11/2001 |
| JP | 2003-280255 | A | 10/2003 |
| JP | 2004325757 | A * | 11/2004 |
| JP | 2016-27399 | A | 2/2016 |
| JP | 2016-38591 | A | 3/2016 |

* cited by examiner

*Primary Examiner* — Susan S Lee
(74) *Attorney, Agent, or Firm* — Canon U.S.A., Inc., IP Division

(57) ABSTRACT

Provided are an image bearing member, a developer bearing member, and a cleaning member. A fixation layer, including at least one of an organosilicon polymer and inorganic particles, is provided on a surface of the developer borne on the developer bearing member, and a fixation percentage of the fixation layer is 85% or greater. The image bearing member and the developer bearing member are rotationally driven such that, a surface of the image bearing member and a surface of the developer bearing member move in opposite directions from each other at a contact portion where the image bearing member and the developer bearing member are in contact with each other.

11 Claims, 5 Drawing Sheets

PROCESS CARTRIDGE PROVIDING FIXATION LAYER TO DEVELOPER ON IMAGE BEARING MEMBER AND IMAGE FORMING APPARATUS

BACKGROUND OF THE INVENTION

Field of the Invention

The present disclosure relates to a process cartridge and image forming apparatus. More particularly, the present disclosure relates to an electrophotography image forming apparatus and a process cartridge detachably mountable to an electrophotographic image forming apparatus.

Description of the Related Art

Generally, a process cartridge used in an electrophotographic image forming apparatus is provided with a photosensitive drum, and a cleaning unit that has a cleaning arrangement for cleaning the surface of the photosensitive drum. Blade cleaning methods are in widespread use in cleaning units.

Specifically, in the related art, a cleaning blade having elasticity is disposed in a direction countering the rotation direction of the photosensitive drum, in contact with the photosensitive drum so as to form a contact portion (nip portion). The surface of the rotating photosensitive drum is cleaned by the contact portion of the blade. Now, there is a possibility that the contact state of the nip portion will become unstable in such a blade cleaning method, and the there are cases where toner particles, which are developer, slip through the cleaning blade (leading to deterioration in cleaning performance).

Japanese Patent Laid-Open No. 2003-280255 proposes a configuration to deal with instances in which a developer is used that has a readily-liberated external additive, with a "prevention layer" formed of the liberated external additive being formed at the nip portion between the photosensitive member and the cleaning blade. This "prevention layer" is interposed in order to reduce friction at the nip portion and improve stability of the contact state and cleaning performance.

On the other hand, developer is being developed in recent years with excellent developing endurance and preservation stability, in order to increase the speed of image formation, extend the life of the device, and so forth. For example, a developer in Japanese Patent Laid-Open No. 2016-27399 has a surface layer including an organosilicon polymer, whereby liberation of external additive is effectively suppressed, which is said to be advantageous regarding developing endurance and preservation stability.

However, in a case where a developer with excellent developing endurance such as in Japanese Patent Laid-Open No. 2016-27399 is used in an image forming apparatus of the related art such as in Japanese Patent Laid-Open No. 2003-280255, there is a possibility that toner particles, which are the developer, will slip through the cleaning blade. It is thought that this is due to forming of the above-described "prevention layer" at the nip portion between the photosensitive member and cleaning blade being difficult with toner particles having excellent developing endurance. That is to say, it is thought to be due to the necessity to make the external additive and surface layer of developer less readily fallen from base particles of toner particles, in order to improve developing endurance.

SUMMARY OF THE INVENTION

It has been found desirable to provide a process cartridge and image forming apparatus to improve cleaning performance of an image bearing member, while improving developing endurance of the developer.

A process cartridge according to the present disclosure includes: an image bearing member, which is rotatable and is configured to bear a developer image formed of developer; a developer bearing member which is configured to be rotatable in a state in contact with the image bearing member in order to supply the developer to the image bearing member, for forming the developer image on a surface of the image bearing member; and a cleaning member disposed in contact with the image bearing member, and configured to clean the surface of the image bearing member by scraping off the developer remaining on the surface of the image bearing member after the developer image is transferred from the image bearing member. A fixation layer, including at least one of an organosilicon polymer and inorganic particles, is provided on a surface of the developer borne on the developer bearing member, and a fixation percentage of the fixation layer on the surface of the developer is 85% or greater. The image bearing member and the developer bearing member are rotationally driven such that, the surface of the image bearing member and a surface of the developer bearing member move in opposite directions from each other at a contact portion where the image bearing member and the developer bearing member are in contact with each other.

An image forming apparatus according to the present disclosure includes the process cartridge, and a fixing device configured to fix the developer to a recording medium.

Further features of the present disclosure will become apparent from the following description of exemplary embodiments with reference to the attached drawings.

DESCRIPTION OF THE EMBODIMENTS

The present disclosure is applicable to either a process cartridge or an image forming apparatus.

An electrophotographic image forming apparatus, in which a process cartridge according to the present disclosure is used, will be described below with reference to the drawings. Note that the embodiment described below is an exemplary description of the present embodiment, and the dimensions, materials, shapes, relation of relative positions, and so forth, of the components described below, do not restrict the scope of the present disclosure unless specifically stated to that effect.

The electrophotographic image forming apparatus here forms images on recording media using an electrophotographic image forming process. Examples of the electrophotographic image forming apparatus include electrophotographic copiers, electrophotographic printers (e.g., laser beam printers, light-emitting diode (LED) printers, etc.), facsimile device, word processors, and so forth.

The process cartridge is an arrangement where a charging arrangement, developing arrangement, cleaning arrangement, and electrophotographic photosensitive drum have been integrally formed into a cartridge, which is detachably mountable to a main assembly of the electrophotographic image forming apparatus. The process cartridge also is an arrangement where at least one of a charging arrangement, developing arrangement, and cleaning arrangement, and an electrophotographic photosensitive drum have been integrally formed into a cartridge, which is detachably mountable to a main assembly of the electrophotographic image forming apparatus. The process cartridge further is an arrangement where at least a developing arrangement and electrophotographic photosensitive drum have been integrally formed into a cartridge, which is detachably mountable to a main assembly of the electrophotographic image forming apparatus.

Electrophotographic Image Forming apparatus

Figure 1:
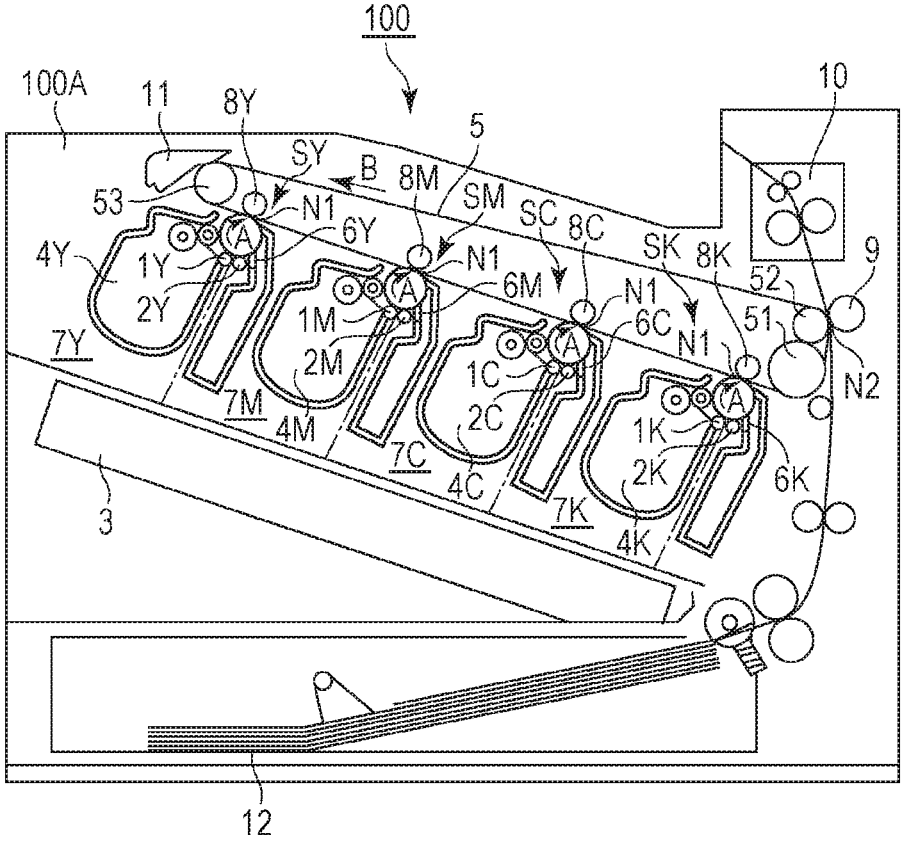
FIG. 1 is a cross-sectional conceptual diagram of an image forming apparatus in which a process cartridge according to an embodiment of the present disclosure is used.

First, the overall configuration of an example of the electrophotographic image forming apparatus (image forming apparatus) in which the process cartridge according to the present disclosure is used, will be described with reference to FIG. 1. FIG. 1 is a cross-sectional conceptual diagram of the image forming apparatus 100 in which the process cartridge according to the present embodiment is used.

The image forming apparatus 100 according to the present embodiment is a full-color laser printer using the inline system and intermediate transfer system, as illustrated in FIG. 1. The image forming apparatus 100 can form full-color images on recording material (e.g., recording sheets, plastic sheets, cloth, etc.) in accordance with image information. Note that image information is input to a main assembly 100A of the image forming apparatus 100 from an image reader connected to the main assembly 100A of the image forming apparatus 100, or a host device such as a personal computer or the like communicably connected to the main assembly 100A of the image forming apparatus 100.

The image forming apparatus 100 has first, second, third, and fourth image forming units SY, SM, SC, and SK, of the respective colors yellow (Y), magenta (M), cyan (C), and black (K). In the present embodiment, the first through fourth image forming units SY, SM, SC, and SK are arrayed in one row in a direction intersecting the vertical direction.

Note that in the present embodiment, the configurations and operations of the first through fourth image forming units SY, SM, SC, and SK are substantially the same except for the colors of images formed. Accordingly, unless there is a particular need to distinguish these, the suffixes Y, M, C, and K indicating which color a component is for will be omitted, and description will be made collectively.

In the present embodiment, the image forming apparatus 100 has four drum-type electrophotographic photosensitive members arrayed in a direction that intersects the vertical direction as multiple imaging bearing members, which are each a photosensitive drum 1. The photosensitive drum 1 is rotationally driven in the direction of the arrows A in FIG. 1 (clockwise direction) by a driving arrangement (drive source) that is omitted from illustration. A charging roller 2 serving as a charging arrangement to uniformly charge the surface of the photosensitive drum 1, and a scanner unit (exposing device) 3 serving as an exposing arrangement that forms electrostatic images (electrostatic latent images) on the photosensitive drum 1 by irradiating the photosensitive drum 1 by laser based on image information, are disposed around the photosensitive drum 1.

Also disposed around the photosensitive drum 1 are a developing unit (developing device) 4 serving as a developing arrangement to develop the electrostatic image into a toner image, and a cleaning member 6 serving as a cleaning arrangement for removing toner remaining on the surface of the photosensitive drum 1 after transfer (transfer residual toner). An intermediate transfer belt 5 is further disposed facing the four photosensitive drums 1, as an intermediate transfer member for transferring the toner images of the photosensitive drums 1 onto a recording medium 12.

Note that in the present embodiment, the developing unit 4 uses non-magnetic one component developer (toner) as a developer. The developing unit 4 in the present embodiment performs reversal developing by bringing a developing roller (described later) serving as a developer bearing member into contact with the photosensitive drum 1. That is to say, in the present embodiment, the developing unit 4 develops an electrostatic image by causing toner, which has been charged to the same polarity as the charging polarity of the photosensitive drum 1 (negative polarity in the present embodiment), to adhere to portions on the photosensitive drum 1 where the charge has been attenuated by exposure (image portion, exposed portion).

The photosensitive drum 1, and the charging roller 2, developing unit 4, and cleaning member 6 serving as a process arrangement that acts on the photosensitive drum 1, are integrally formed into a cartridge in the present embodiment, i.e., formed as a process cartridge 7. The process cartridge 7 is detachably mountable to the image forming apparatus 100 by way of a mounting arrangement such as a mounting guide, positioning member, and so forth, provided to the main assembly 100A of the image forming apparatus 100. The process cartridges 7 of each of the colors all have the same shape in the present embodiment, and toner of the colors yellow (Y), magenta (M), cyan (C), and black (K) being accommodated within the process cartridge 7 of the respective colors.

The intermediate transfer belt 5 formed of an endless belt to serve as the intermediate transfer member comes into contact with all of the photosensitive drums 1, and circularly moves (rotates) in the direction of the arrow B in FIG. 1 (counterclockwise direction). The intermediate transfer belt 5 is passed over a driving roller 51, a secondary transfer opposing roller 52, and a driven roller 53, serving as multiple support members. Four primary transfer rollers 8 serving as primary transfer arrangements are arrayed on the inner peripheral face of the intermediate transfer belt 5, facing the respective photosensitive drums 1.

The primary transfer roller 8 pressures the intermediate transfer belt 5 toward the photosensitive drum 1, and forms a primary transfer portion N1 where the intermediate transfer belt 5 and photosensitive drum 1 come into contact. Bias that is of opposite polarity to the regular charging polarity of the toner is applied to the primary transfer roller 8 from a primary transfer bias power source (high-voltage power source) serving as a primary transfer bias applying arrangement that is omitted from illustration. Accordingly, the toner image on the photosensitive drum 1 is transferred (primary transfer) onto the intermediate transfer belt 5.

A secondary transfer roller 9 serving as a secondary transfer arrangement is disposed at a position facing the secondary transfer opposing roller 52 at the outer peripheral face side of the intermediate transfer belt 5. The secondary transfer roller 9 is in pressure contact with the secondary transfer opposing roller 52 across the intermediate transfer belt 5, thereby forming a secondary transfer portion N2 where the intermediate transfer belt 5 and secondary transfer roller 9 come into contact. Bias that is of opposite polarity to the regular charging polarity of the toner is applied to the secondary transfer roller 9 from a secondary transfer bias power source (high-voltage power source) serving as a secondary transfer bias applying arrangement that is omitted from illustration. Accordingly, the toner image on the intermediate transfer belt 5 is transferred (secondary transfer) onto the recording medium 12.

Specifically, when forming an image, first, the surface of the photosensitive drum 1 is uniformly charged by the charging roller 2. Next, scanning exposure of the charged surface of the photosensitive drum 1 is performed by laser light emitted from the scanner unit 3 in accordance with image information, and an electrostatic image is formed on the photosensitive drum 1 in accordance with the image information.

Next, the latent image formed on the photosensitive drum 1 is developed as a toner image (developer image) by the developing unit 4. The toner image formed on the photosensitive drum 1 is transferred (primary transfer) onto the intermediate transfer belt 5 by action of the primary transfer roller 8. For example, when forming a full-color image, the above-described process is performed in order at the first through fourth image forming units SY, SM, SC, and SK, and primary transfer is performed with the toner images of each of the colors being overlaid on each other on the intermediate transfer belt 5.

Thereafter, the recording medium 12 is conveyed to the secondary transfer portion N2 synchronously with the movement of the intermediate transfer belt 5. The toner images of four colors on the intermediate transfer belt 5 are subjected to secondary transfer onto the recording medium 12 together, by operations of the secondary transfer roller 9 in contact with the intermediate transfer belt 5 across the recording medium 12.

The recording medium 12 onto which the toner images have been transferred is conveyed to a fixing device 10 serving as a fixing arrangement. The toner images are fixed to the recording medium 12 due to the fixing device 10 by applying heat and pressure to the recording medium 12.

Also, primary transfer residual toner remaining on the photosensitive drum 1 after the primary transfer process is removed by the cleaning member 6 and recovered. Secondary transfer toner remaining on the intermediate transfer belt 5 after the secondary transfer process is cleaned by an intermediate transfer belt cleaning device 11.

The image forming apparatus 100 can also form a single-color or multi-color image using only one or some (not all) image forming units.

Process Cartridge

Next, the overall configuration of the process cartridge 7 used in a state mounted to the image forming apparatus 100 according to the present embodiment will be described with reference to FIG. 2. Note that in the present embodiment, the configurations and operations of the process cartridges 7 of each of the colors are substantially the same except for the type (color) of toner accommodated.

Figure 2:
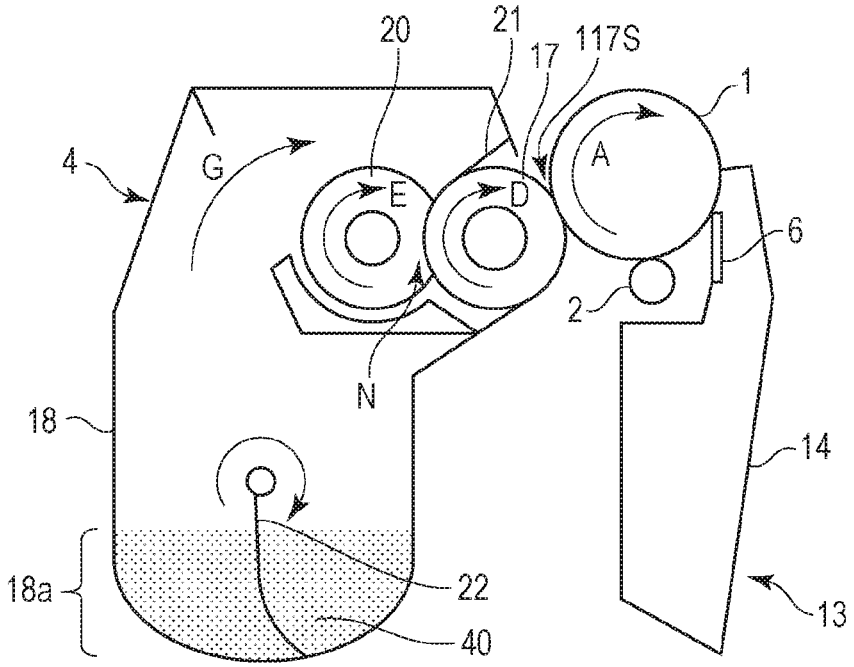
FIG. 2 is a cross-sectional conceptual diagram of a process cartridge according to an embodiment of the present disclosure.

FIG. 2 is a cross-sectional conceptual diagram of the process cartridge according to the present embodiment. More specifically, FIG. 2 is a cross-sectional (principal section) conceptual diagram of the process cartridge 7 according to the present embodiment, taken along the longitudinal direction (rotation axis direction) of the photosensitive drum 1. Note that the attitude of the process cartridge 7 illustrated in FIG. 2 is an attitude in a state of having been mounted to the main assembly 100A of the image forming apparatus 100. When description is made regarding the positional relation, direction, and so forth of the members of the process cartridge 7 below, this is to be understood to be regarding the attitude illustrated in FIG. 2 unless stated otherwise.

The process cartridge 7 has a photosensitive unit 13 provided with the photosensitive drum 1 and so forth, and the developing unit 4 provided with a developing roller 17 and so forth, integrally configured, as illustrated in FIG. 2.

The photosensitive unit 13 has a cleaning frame 14 serving as a frame member that supports various types of elements within the photosensitive unit 13. The cleaning frame 14 has the photosensitive drum 1 rotationally attached thereto through a bearing omitted from illustration.

The photosensitive drum 1 is rotationally driven in the direction of the arrow A illustrated in FIG. 2, by driving force of a driving motor serving as a driving arrangement (driving source), omitted from illustration, being transmitted to the photosensitive unit 13, in accordance with image forming operations. In the present embodiment, an organic photosensitive drum that has a undercoating layer that is a functional film, a carrier generating layer, and a carrier transporting layer, sequentially coated on the outer peripheral face of an aluminum cylinder that is 24 mm in outer diameter, is used as the photosensitive drum 1 that is the center of the image forming process.

The cleaning member 6 and charging roller 2 are disposed in the photosensitive unit 13 so as to come into contact with the peripheral face of the photosensitive drum 1. The transfer residual toner removed from the surface of the photosensitive drum 1 by the cleaning member 6 falls into the cleaning frame 14, and is accommodated.

Figure 3:
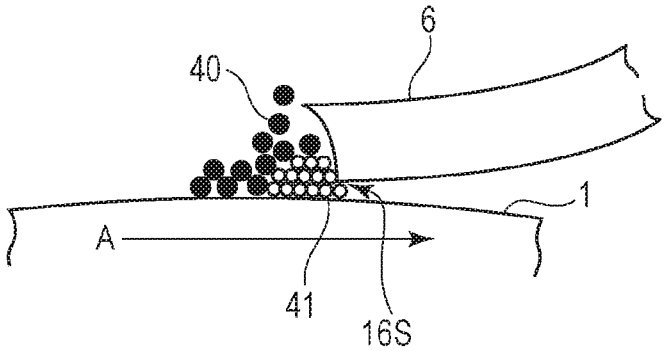
FIG. 3 is a schematic diagram of around a nip portion between a cleaning member and photosensitive drum of the process cartridge according to an embodiment of the present disclosure.

FIG. 3 illustrates the configuration of a nip portion 16S between the cleaning member 6 and photosensitive drum 1, near the cleaning member 6. FIG. 3 is a schematic diagram of around the nip portion between the cleaning member and photosensitive drum.

Toner falling particles 41 (substance falling from the developer) and toner 40 (developer) have accumulated as illustrated in FIG. 3, and a prevention layer is formed that prevents the toner 40 from slipping through. Note that in the present embodiment, a cleaning blade made of urethane rubber is used for the cleaning member 6.

The charging roller 2 that is a charging arrangement is rotationally driven by an electroconductive rubber roller portion being in pressure contact with the photosensitive drum 1. A predetermined DC voltage as to the photosensitive drum 1 is applied to a core of the charging roller 2 in the charging process. Thus, a uniform dark area potential (Vd) is formed on the surface of the photosensitive drum 1.

A spot pattern of a laser beam emitted in accordance with image data exposes the photosensitive drum 1, by the laser beam from the scanner unit 3. Note that the charge on the surface of the photosensitive drum 1 that has been exposed is lost due to carriers from the carrier generating layer, and the potential drops. As a result, an electrostatic latent image having a predetermined light area potential (V1) at exposed portions and a predetermined dark area potential (Vd) at unexposed portions is formed on the photosensitive drum 1. In the present embodiment, Vd=−500 V and V1=−100 V.

Developing Unit

A developing unit making up part of the process cartridge according to the present embodiment will be described in detail. The developing unit 4 has a developing chamber 19*a*, the developing roller 17 serving as a developer bearing member that is disposed in the developing chamber 19*a* and bears the toner 40, and a toner supply roller 20 serving as a supply member that supplies the toner 40 to the developing roller 17, as illustrated in FIG. 2.

The developing unit 4 further has a toner accommodation chamber 18 that accommodates toner. A toner accommodation portion (developer accommodation portion) 18*a* of the toner accommodation chamber 18 is disposed downwards from the toner supply roller 20 in the gravitational direction. An agitating-and-conveying member 22 is provided within the toner accommodation chamber 18. The agitating-and-conveying member 22 agitates the toner accommodated within the toner accommodation chamber 18, and also can convey toner toward the top of the toner supply roller 20, in the direction of the arrow G in FIG. 2. The agitating-and-conveying member 22 is rotationally driven at 60 rpm in the present embodiment.

DC bias is applied to the developing roller 17 when performing developing operations in image formation. Toner negatively changed by triboelectric charging on the developing roller is transferred only to light area potential portions at a developing portion where contact is made with the photosensitive drum 1 due to potential difference between the photosensitive drum 1 and the developing roller 17, and thus the electrostatic latent image in the photosensitive drum 1 can be visualized. In the present embodiment, V=−300 V is applied to the developing roller 17, thereby forming a potential difference of ΔV=200 V as to light area potential portions, and a toner image is formed on the photosensitive drum 1.

The toner supply roller 20 and developing roller 17 are rotationally driven so that the surfaces thereof move in opposite directions at a facing portion (contact portion 20S). That is to say, the toner supply roller 20 is rotated in the direction of the arrow E in FIG. 2 (clockwise direction), and the developing roller 17 is rotated in the direction of the arrow D in FIG. 2 (clockwise direction).

The toner supply roller 20 is an elastic sponge roller where a foam layer is formed on the outer periphery of an electroconductive core. The toner supply roller 20 and developing roller 17 are in contact with a predetermined amount of invasion, a depression amount ΔE by which the toner supply roller 20 is depressed by the developing roller 17.

Further, the amount of toner supplied to the developing roller 17 can be adjusted by adjusting the potential difference between the toner supply roller 20 and the developing roller 17. Note that in the present embodiment, the toner supply roller 20 is rotationally driven at 100% rotational speed as to the developing roller 17, and DC bias is applied so that the toner supply roller 20 is Δ-50 V as to the developing roller 17. That is to say, V=−300 V is applied to the developing roller 17, and V=−350 V is applied to the toner supply roller 20. Accordingly, this creates an electric state where toner is readily supplied from the toner supply roller 20 to the developing roller 17.

Note that in the present embodiment, the developing roller 17 and the toner supply roller 20 are both 15 mm in outer diameter, and the amount of invasion of the developing roller 17 into the toner supply roller 20, i.e., the depression amount ΔE by which the toner supply roller 20 is depressed by the developing roller 17 is set to be 1.0 mm. The toner supply roller 20 and the developing roller 17 are also disposed so that the centers (axial centers) thereof are at approximately the same height, as illustrated in FIG. 2.

A developing blade (restricting blade) 21 serving as a restricting member that functions as a restricting blade restricts the amount of toner borne on the developing roller 17. Specifically, the free end of the developing blade 21 is disposed facing the counter direction of the rotation direction of the developing roller 17 (the upstream side in the direction of rotation). The amount of toner borne on the developing roller 17 is restricted at the free end of the developing blade 21. The toner is imparted with a charge due to triboelectric charging by rubbing between the developing blade 21 and the developing roller 17, while at the same time the layer thickness of the toner is restricted. A thin plate of stainless steel in the form of a leaf spring is used as the developing blade 21 in the present embodiment.

Now, the material of the developing blade 21 is not restricted to stainless steel. For example, a thin plate of metal, such as phosphor bronze, aluminum, or the like may be used. An arrangement where the surface of the developing blade 21 is covered by a thin film of polyamide elastomer, urethane rubber, urethane resin, or the like, may be used as well.

Further, a predetermined voltage may be applied to the developing blade 21 from a blade bias power source that is omitted from illustration. Accordingly, coating with toner can be stably performed. For example, a blade bias of V=−500 V is applied to the developing blade 21 in the present embodiment.

Next, the configuration of a contact portion 117S between the developing roller 17 and photosensitive drum 1 in the present embodiment will be described in detail with reference to FIG. 2. The developing roller 17 and photosensitive drum 1 are disposed in contact with each other in the present embodiment, as illustrated in FIG. 2. The developing roller 17 and the photosensitive drum 1 are rotationally driven in the same rotation direction, so that the surfaces thereof move in the opposite directions from each other (direction of arrows) at the contact portion 117S.

Also, in the present embodiment, a rotation peripheral speed difference is created between the developing roller 17 and photosensitive drum 1, and further an invasion amount ΔD is provided, so the toner can be rubbed more mechanically. As a result, falling particles from the toner being transferred to the photosensitive drum 1 can be increased, and a "prevention layer" can be formed more readily at the nip portion 16S between the photosensitive drum 1 and cleaning member (cleaning blade) 6.

Note that in the present embodiment, the invasion amount ΔD=40 μm is set for the contact portion 117S between the developing roller 17 and photosensitive drum 1. The driving rotation speed of the photosensitive drum 1 is set to 200 rpm, and the driving rotation speed ratio of the developing roller 17 as to the photosensitive drum 1 may be X % (where X>100).

Developer (Toner)

Figure 4A:
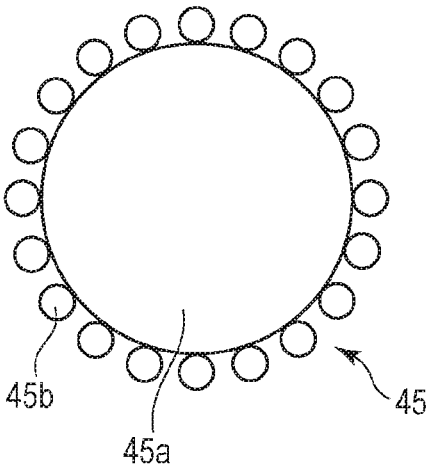
FIG. 4A is a schematic diagram illustrating a first type of developer used in the process cartridge according to an embodiment of the present disclosure.
Figure 4B:
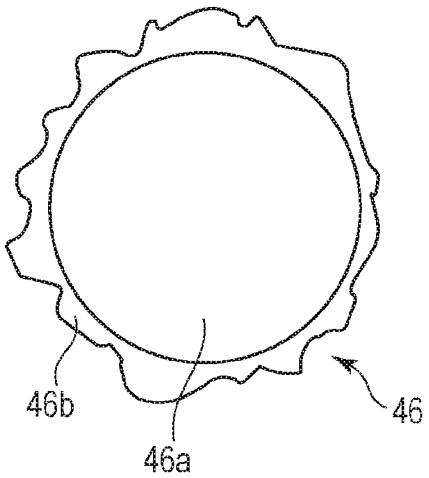
FIG. 4B is a schematic diagram illustrating a second type of developer used in the process cartridge according to an embodiment of the present disclosure.

Next, two types of developer employed in the present embodiment will be described with reference to FIGS. 4A and 4B. Note that FIG. 4A is a schematic diagram illustrating a first type of developer, and FIG. 4B is a schematic diagram illustrating a second type of developer.

The developer of the first type (toner) in the present embodiment is an inorganic-particle external-additive toner 45, where inorganic particles 45*b* have been added as an external additive to toner base particles 45*a*. That is to say, with the developer of the first type, a later-described "fixation layer" is formed on the surface layer of the base particles by the external additive being physically adsorbed at the surface of the base particles of the developer.

On the other hand, the developer of the second type is an organosilicon polymer toner 46 having a surface layer 46*b* that contains an organosilicon polymer, on each of the toner base particles 46*a*. That is to say, with the developer of the second type, a later-described "fixation layer" is formed integrally with each of the base particles of the developer, by chemical bonding at the surface of each of the base particles of the developer.

Next, the external addition conditions and fixation percentages for developers of the first type (toner samples) are shown in Table 1.

TABLE 1

| (Developer of first type) No. | External addition conditions for first stage: Device | Peripheral speed (m/s) | Time (sec) | External addition conditions for second stage: Device | Peripheral speed (m/s) | Time (sec) | Fixation percentage of inorganic-particle external-additive toner (%) |
|---|---|---|---|---|---|---|---|
| Toner a | Surface | 430 | 200 | Surface | 30 | 30 | 70* |
| Toner b | improvement | 40 | 200 | improvement | 40 | 40 | 80* |
| Toner c | device | 40 | 300 | device | 40 | 60 | 85 |

Note that for "Toner a" through "Toner c" in Table 1, the inorganic-particle external-additive toner 45 manufactured by the manufacturing method disclosed in the fifth embodiment of Japanese Patent Laid-Open No. 2016-38591 is used. The toner base particles 45a, and inorganic particles 45b serving as external additive, also are manufactured by the manufacturing # method disclosed in the fifth embodiment of the same Publication. Comparative examples for the present embodiment are indicated by asterisks "*".

In the present embodiment and comparative examples, the fixation percentage of the external additive of inorganic particles is set to 70 to 85%. Note that the fixation percentage of the external additive of inorganic particles can be changed by adjusting the "peripheral speed" and "time", which are external addition conditions.

Next, the polymerization conditions and fixation percentages for developers of the second type (toner samples) are shown in Table 2.

TABLE 2

| (Developer of second type) No. | Polymerization conditions (reaction 3): Temperature | Holding time | pH | Fixation percentage of organosilicon polymer (%) |
|---|---|---|---|---|
| Toner d | 100 | 2 | 4.1 | 93 |
| Toner e | 100 | 5 | 4.1 | 98 |

Note that for "Toner d" and "Toner e" in Table 2, the organosilicon polymer toner 46 manufactured by the manufacturing method disclosed in the first embodiment of Japanese Patent Laid-Open No. 2016-27399 is used. The "surface layer 46b that contains an organosilicon polymer" making up the surface layer of each of the toner base particles 46a also is manufactured by the manufacturing method disclosed in the first embodiment of the same Publication.

In the present embodiment, the fixation percentage of the organosilicon polymer is set to 93 to 98%. Note that the fixation percentage of the organosilicon polymer can be changed by adjusting the polymerization conditions of the particles.

It is generally conceivable that the higher the fixation percentage of the external additive of inorganic particles in the developer of the first type or the fixation percentage of the organosilicon polymer in the developer of the second type, the better the "developing endurance" is. Consequently, it is more difficult to generate "falling particles" that makes the later-described "prevention layer" with developers that have a high fixation percentage, as compared to developers that have a low fixation percentage, in normal use of the process cartridge. "Falling particles" as used here is substances that can peel off and fall away from toner base particles, such as the external additive in the developer of the first type or the organosilicon polymer surface layer in the developer of the second type.

Measuring Fixation Percentage

For the measurement method of fixation percentages of the present embodiment and comparative examples, the measurement method disclosed in the aforementioned Japanese Patent Laid-Open No. 2016-38591 can be used. This will be described in detail below.

160 g of sucrose (manufactured by Kishida Chemical Co., Ltd.) is added to 100 mL of ion exchanged water and dissolved using hot water bath, thereby preparing a sucrose concentrate.

31 g of the above sucrose concentrate, and 6 mL of Contaminon N (a 10% by mass aqueous solution of a precision measurement instrument cleansing neutral detergent that has a pH of 7 and is made of nonionic surfactant, anionic surfactant, and an organic builder, manufactured by FUJIFILM Wako Pure Chemical Corporation) are placed in a centrifuge tube, and a fluid dispersion is created. 1 g of toner is added to this fluid dispersion, and toner clumps are worked out using a spatula or the like.

The centrifuge tube is shaken in a shaker for 20 minutes at 350 rpm. After shaking, the solution is transferred to a swing rotor glass tube (50 mL), and separated using a centrifuge under the conditions of 30 minutes at 3500 rpm.

Upon visual confirmation that the toner and solution have been sufficiently separated, the toner that has separated to the topmost layer is recovered using a spatula or the like. The solution containing the recovered toner is filtered using a vacuum filter, and thereafter dried one hour or more using a dryer. The dried product is pulverized using a spatula, and the amount of external additive is measured by fluorescent X-rays (aluminum ring 10 mm in diameter). The fixation percentage (%) is then calculated from the amount of inorganic particle external additive and organosilicon polymer of toner after washing, and the amount of inorganic particle external additive and organosilicon polymer of the initial toner.

Fluorescent X-ray measurement of the elements follows JIS K 0119-1969, as described in detail below.

For measuring equipment, a wavelength-dispersive X-ray fluorescence analyzer "Axios" (manufactured by Malvern Panalytical Ltd), and accessory dedicated software "SuperQ ver. 4.0F" (from Malvern Panalytical Ltd) for setting measurement conditions and analyzing measurement data, are used.

Rhodium (Rh) is used for the anode of the x-ray tube, and measurement time is ten seconds in a vacuum measurement atmosphere, with a measurement diameter (diameter of collimator mask) of 10 mm Detection is made using a proportional counter (PC) in a case of measuring light elements and using a scintillation counter (SC) in a case of measuring heavy elements.

For the measurement sample, approximately 1 g of the washed toner and initial toner are placed in a specialized aluminum ring for pressing, leveled off, and pressurized for 60 seconds at 20 MPa using a tablet briquetting press "BRE-32" (manufactured by Maekawa Testing Machine MFG, Co., LTD.) to yield a pellet. The thickness of the pellet is approximately 2 mm.

Measurement is performed under the above conditions, elements are identified based on peak positions of X-rays obtained, and the concentration thereof is calculated from a count rate that is the count of X-ray photons per unit of time (in counts per second (cps)).

As a quantification method of $SiO_2$ in the toner, for example, 0.10 parts by mass of a silica fine powder is added to 100 parts by mass of toner particles, and then sufficiently mixed using a coffee mill.

In the same way, 0.20 parts by mass and 0.50 parts by mass of silica fine powder are added to toner particles, and used as specimens for calibration curves.

Pellets of specimens for calibration curves are produced for each specimen as described above using the tablet briquetting press, and the count rate (in cps) of Si-K$\alpha$ rays measured at diffraction angle ($2\theta$)=109.08° is measured using pentaerythritol (PET) as an analyzing crystal. At this time, the accelerating voltage and current value of the X-ray generator respectively are 24 kV and 100 mA. A linear function calibration curve is obtained where the count rate of X-rays obtained is the vertical axis and the amount of $SiO_2$ added to each specimen for calibration curve as the horizontal axis.

Next, the toner to be analyzed is formed into a pellet as described above using the tablet briquetting press, and the count rate of Si-K$\alpha$ rays is measured. The amount of $SiO_2$ in the toner is calculated from the above calibration curve. The proportion of the amount of inorganic particle external additive and organosilicon polymer of the washed toner as to the amount of inorganic particle external additive and organosilicon polymer of the initial toner is found, and taken as the fixation percentage (%) of the inorganic particle external additive and organosilicon polymer.

Evaluation Experiments

(1) Evaluation Experiment for Present Embodiment

Evaluation experimentation regarding the configuration of the present embodiment will be described below.

The value of X for the driving rotation speed ratio of the developing roller 17 as to the photosensitive drum 1 according to the present embodiment was set to X=160, and evaluation of the state of contamination of the charging roller 2 that is a charging member (charging member contamination) due to toner slipping through was performed using "toner a" through "toner e" in Tables 1 and 2 above.

Note that "charging member contamination" occurs when toner that has slipped through the nip portion 16S between the photosensitive drum 1 and cleaning member 6 adheres to the charging member situated downstream in the rotation direction of the photosensitive drum 1. On the other hand, it is conceivable that toner can be suppressed from slipping through by the amount of the "prevention layer" formed at the nip portion. That is to say, the amounts of "charging member contamination" and "prevention layer" are thought to have a correlation. Accordingly, whether the amount of "falling particles" forming the "prevention layer" is sufficient or not can be judged (estimated) according to the state of "charging member contamination".

Also, "developing endurance" of the developer (toner) can be judged (estimated) according to the state of "developing streaks" due to toner deterioration. The state of "developing streaks" (developing endurance) was also evaluated in the present evaluation experiment.

Note that for evaluation conditions in the present embodiment, the developer was let standing one night (ten hours) in a low-temperature and low-humidity environment (10° C. and 14% relative humidity) to become acclimated to the environment, and thereafter image forming operations on recording media was performed based on experimentation image data. The image forming operations were intermittently performed on 10,000 sheets of recording media. Horizontal lines having 5% image coverage were used as the experimentation image data in the present embodiment. After performing image forming operations under the above-described conditions, evaluation was performed regarding the above-described evaluation items.

(2) Evaluation Experiment for Comparative Example

Figure 5:
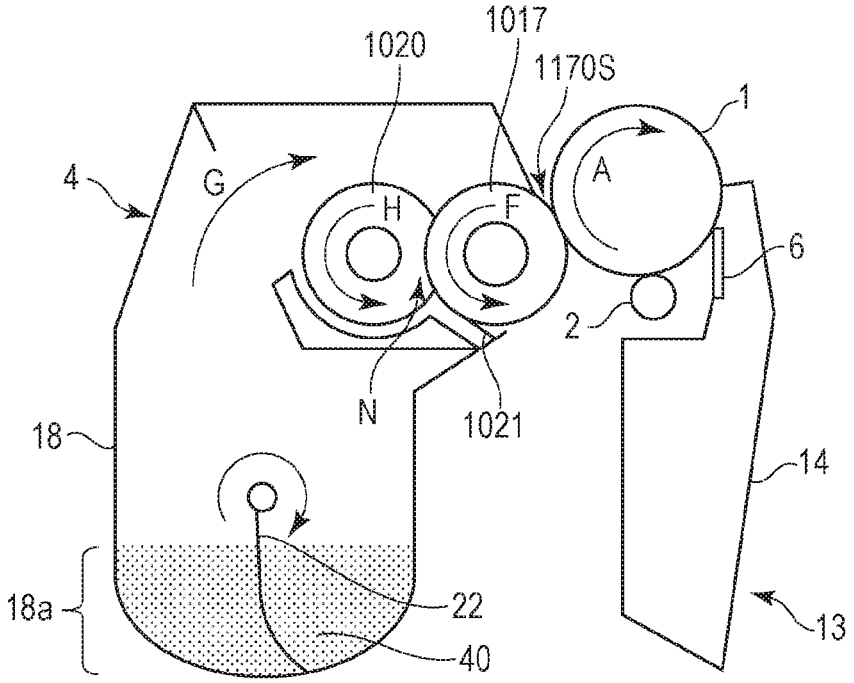
FIG. 5 is a cross-sectional diagram of a process cartridge according to a comparative example, for comparison with the process cartridge according to an embodiment of the present disclosure.

A comparison experiment was performed using the configuration of a comparative example illustrated in FIG. 5, in comparison with the effects of the present embodiment described above. FIG. 5 is a cross-sectional view of a process cartridge according to the comparative example.

In this comparative example, a developing roller 1017 and the photosensitive drum 1 are provided in contact, as illustrated in FIG. 5. The developing roller 1017 rotates in the direction of the arrow F opposite to the rotation direction of the photosensitive drum 1 rotating at a predetermined rotation speed, so that the surface of the developing roller 1017 is moving in the same direction as the surface of the photosensitive drum 1 at a contact portion therebetween. A toner supply roller 1020 is rotated in the direction of the arrow H in FIG. 5, and a developing blade 1021 is disposed facing the counter direction of the rotation of the developing roller 1017. Other configurations of the present embodiment are the same as in the above-described present embodiment. Evaluation conditions of this comparative example also are the same as with the present embodiment described above. After performing image forming operations under the above-described evaluation conditions, evaluation was performed regarding the above-described evaluation items, and comparison was made with the present embodiment.

(3) Results of Evaluation Experiments for Present Embodiment and Comparative Example Evaluation results regarding the state of "charging member contamination" and "developing streaks" for the present embodiment and comparative example are shown in Table 3.

TABLE 3

| | Developer of first and second types | | | |
|---|---|---|---|---|
| | No. | Fixation percentage of inorganic-particle external-additive toner or organosilicon polymer (%) | Charging member contamination | Developing streaks |
| Present embodiment (opposite directions) | Toner c | 85 | Good | Good |
| | Toner d | 93 | Good | Good |
| | Toner e | 98 | Good | Good |
| Comparative example (same direction*) | Toner a | 70* | Good | Poor |
| | Toner b | 80* | Poor | Good |
| | Toner c | 85 | Poor | Good |
| | Toner d | 93 | Poor | Good |
| | Toner e | 98 | Poor | Good |

First, in a case of using toners c through e in the configuration according to the present embodiment, "charging member contamination" was able to be suppressed while suppressing "developing streaks". On the other hand, in a case of using toner a or b, the fixation percentage was low, and developing endurance was low, so "developing streaks" occurred.

Also, in a case of using toners b through e in the configuration of comparative example 1, which is described in Table 4 later, and in which "charging member contamination" could not be effectively suppressed. Also, in a case of using toner a, "developing streaks" occurred in the same way as with the present embodiment.

Figure 6A:
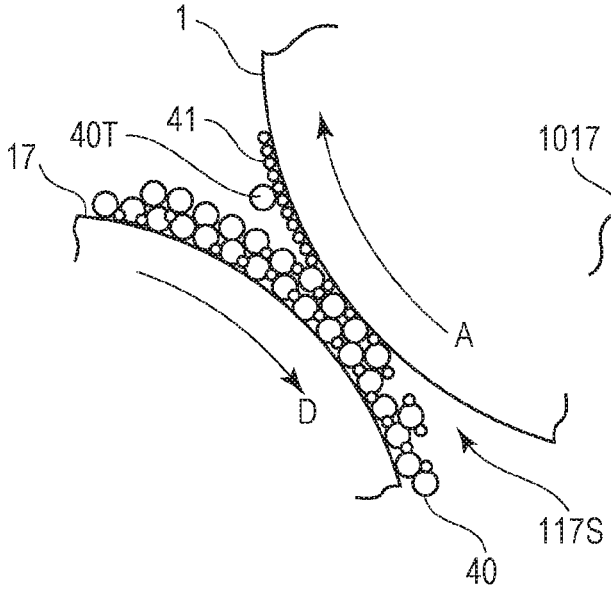
FIG. 6A is a schematic diagram of around a contact portion between a developer bearing member and photosensitive member in the process cartridge according to an embodiment of the present disclosure.
Figure 6B:
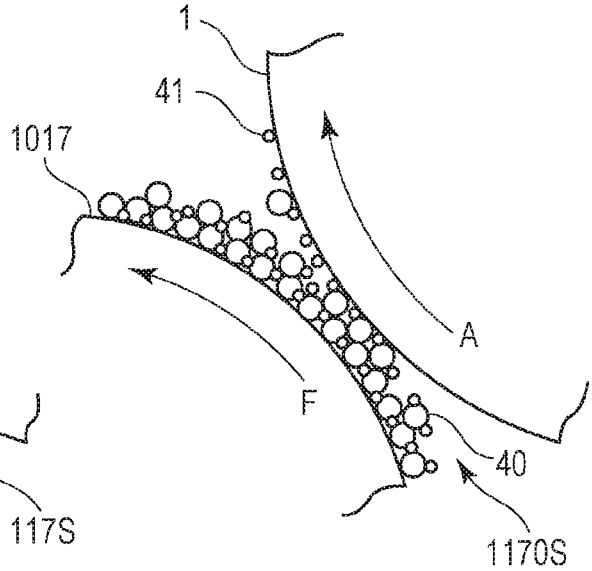
FIG. 6B is a schematic diagram of around a contact portion between a developer bearing member and photosensitive member in the process cartridge according to a comparative example.

The mechanism of forming the "prevention layer" will be described here with reference to FIGS. 6A and 6B. FIG. 6A is a schematic diagram of around a contact portion 117S between the photosensitive drum 1 and developing roller 17 according to the present embodiment. FIG. 6B is a schematic diagram of around a contact portion 1170S between the photosensitive drum 1 and developing roller 1017 of the comparative example 1 (described in Table 4).

The following two points are thought to be important in promoting the formation of the "prevention layer", as illustrated in FIGS. 6A and 6B. That is to increase the amount of falling particles generated from the toner base particles, for forming the "prevention layer", and to increase the amount of falling particles that migrates to the nip portion 16S between the photosensitive drum 1 and cleaning member 6 (migration amount).

In the case of the present embodiment illustrated in FIG. 6A, the toner is strongly rubbed at the contact portion between the photosensitive drum 1 and developing roller 17. Accordingly, it is thought that the amount of toner falling particles 41 generated at the contact portion 117S between the photosensitive drum 1 and developing roller 17 increases.

Also, the falling particles is generated at the contact portion 117S near the nip portion 16S, so the migration amount (migration percentage) of falling particles that migrates to the nip portion 16S is greater as compared to a case where falling particles is generated within the developing unit 4 far away from the nip portion 16S. Accordingly, both the amount of toner falling particles generated and the migration amount (migration percentage) can be increased in the present embodiment, and the "prevention layer" is readily formed. Accordingly, toner slipping through the nip portion 16S between the cleaning member 6 and photosensitive drum 1 (e.g., "charging member contamination") is suppressed.

On the other hand, in the case of the comparative example 1 (described in Table 4) illustrated in FIG. 6B, the toner is less readily rubbed at the contact portion 1170S between the photosensitive drum 1 and developing roller 17, as compared with the present embodiment. Accordingly, the amount of toner falling particles 41 generated at the contact portion 1170S between the photosensitive drum 1 and developing roller 17, and the migration amount (migration percentage) thereof, are both smaller in comparison with the present embodiment. Thus, it is thought that the "prevention layer" is formed less readily at the nip portion between the cleaning member 6 and photosensitive drum 1, and that toner slips through relatively readily.

From the above experiment results, it was found that if toner that has a fixation percentage of 85% or higher for the fixation layer is used, there is little toner deterioration ("developing streaks") that occurs even if a configuration is used where the surfaces of the developing roller 17 and photosensitive drum 1 move in opposite directions at the contact portion therebetween. It was also found that there is little toner slipping through the nip portion with this configuration, and that "charging member contamination" was effectively suppressed.

(4) Verification of Association Between Configuration and Effects

The association between the configuration of the present embodiment and the effects thereof will be described. The value of X for the driving rotation speed ratio of the developing roller 17 as to the photosensitive drum 1 was adjusted, and the state of "charging member contamination" occurring due to toner slipping through was analyzed (evaluated) using toner c and toner e. Analysis (evaluation) of the state of "developing streaks" at this time was also performed, to confirm the effects on developing endurance.

The toner samples were let standing one night (about ten hours) in a low-temperature and low-humidity environment (10° C. and 14% relative humidity) to become acclimated to the environment, as evaluation conditions, and thereafter image forming operations on recording media was performed based on experimentation image data. The image forming operations were intermittently performed on 10,000 sheets of recording media, following which analysis (evaluation) was performed. Horizontal lines having 5% image coverage were used as the experimentation image in the present embodiment. The results of analysis (evaluation) of the state of "charging member contamination" and the state of "developing streaks" of the present embodiment and comparative example 1 using toner c and toner e are shown below in Tables 4 and 5.

TABLE 4

| Developer of first type (toner c) | Driving rotation speed ratio X | Charging member contamination | Developing streaks |
|---|---|---|---|
| Present embodiment (opposite directions) | 80 | Good | Good |
| | 100 | Good | Good |
| | 150 | Good | Good |
| | 200 | Good | Good |

TABLE 4-continued

| Developer of first type (toner c) | Driving rotation speed ratio X | Charging member contamination | Developing streaks |
|---|---|---|---|
| | 250 | Good | Good |
| | 280 | Good | Fair |
| | 300 | Good | Fair |
| Comparative example 1 (same direction*) | 80 | Poor | Good |
| | 100 | Poor | Good |
| | 150 | Poor | Good |
| | 200 | Poor | Good |
| | 250 | Poor | Good |
| | 280 | Good | Poor |
| | 300 | Good | Poor |

Analysis and evaluation of experiments performed regarding the following two cases were made in a case of using the toner c shown in Table 4 as an example of the developer of the first type. These two cases are a case (the present embodiment) where the direction of movement of the surfaces of the developing roller 17 and photosensitive drum 1 at the contact portion are "opposite directions" (i.e., the directions of rotation are the same), and a case where the direction of movement of the surfaces of the developing roller 17 and photosensitive drum 1 at the contact portion are "same direction" (i.e., the directions of rotation are opposite). It was found that in the case of the configuration of the present embodiment (i.e., "opposite direction"), "developing streaks" were effectively suppressed and "charging member contamination" was also effectively suppressed at driving rotation speed ratio X=80 to 250%.

In a case where the driving rotation speed ratio X=280% in the present embodiment, the toner on the developing roller 17 apparently was strongly rubbed at the contact portion (nip portion) between the toner supply roller 20 and developing roller 17, promoting deterioration of the toner within the developing unit 4. As a result, slight "developing streaks" were confirmed, although within an acceptable range. On the other hand, in the case of the configuration of comparative example 1 (i.e., "same direction"), no pronounced "developing streaks" occurred where driving rotation speed ratio X=80 to 280%, but "charging member contamination" occurred.

Note that in a case where the driving rotation speed ratio X=300% with comparative example 1, the increased driving rotation speed ratio causes the toner to be strongly rubbed. Consequently, it appears that formation of toner falling particles necessary for forming the "prevention layer" increased, thereby improving "charging member contamination". On the other hand, promotion of toner deterioration resulted in "developing streaks" occurring.

TABLE 5

| Developer of second type (toner e) | Driving rotation speed ratio X | Charging member contamination | Developing streaks |
|---|---|---|---|
| Present embodiment (opposite directions) | 80 | Fair | Good |
| | 100 | Good | Good |
| | 150 | Good | Good |
| | 200 | Good | Good |
| | 250 | Good | Good |
| | 280 | Good | Good |
| | 300 | Good | Fair |

TABLE 5-continued

| Developer of second type (toner e) | Driving rotation speed ratio X | Charging member contamination | Developing streaks |
|---|---|---|---|
| Comparative example 2 (same direction*) | 80 | Poor | Good |
| | 100 | Poor | Good |
| | 150 | Poor | Good |
| | 200 | Poor | Good |
| | 250 | Poor | Good |
| | 280 | Poor | Good |
| | 300 | Good | Poor |

Analysis and evaluation of experiments performed regarding the following two cases were made in a case of using the toner e shown in Table 5 as an example of the developer of the second type, in the same way as described above. These two cases are a case (the present embodiment) where the direction of movement of the surfaces of the developing roller 17 and photosensitive drum 1 at the contact portion are "opposite directions", and a case where the direction of movement of the surfaces of the developing roller 17 and photosensitive drum 1 at the contact portion are "same direction". It was found that in the case of the configuration of the present embodiment (i.e., "opposite direction"), "developing streaks" were effectively suppressed and "charging member contamination" was also effectively suppressed at driving rotation speed ratio X=100 to 280%.

Note that in the present embodiment, in a case of driving rotation speed ratio X=80%, the amount of toner falling particles generated and the migration amount both decrease, since the fixation percentage of the toner e is high. As a result, slight "charging member contamination" was observed, although within an acceptable range. Also, in a case where the driving rotation speed ratio X=300%, slight "developing streaks" were confirmed although within an acceptable range, in the same way as with the toner c shown in Table 4.

On the other hand, in the case of the configuration of comparative example 2 (i.e., "same direction"), which is described in Table 5, no pronounced "developing streaks" occurred where the driving rotation speed ratio X=80 to 280%, but "charging member contamination" occurred. Note that in a case where the driving rotation speed ratio X=300% with comparative example 2, improvement in "charging member contamination" was observed, in the same way as with the toner c in Table 4, but "developing streaks" occurred.

It can be understood from the description above that with the configuration of the present embodiment, toner falling particles 41 is effectively generated at the contact portion 117S between the developing roller 17 and photosensitive drum 1, and thereafter conveyed to the nip portion 16S between the photosensitive drum 1 and cleaning member 6, effectively forming a "prevention layer". The configuration of the present embodiment can be summarized as follows.

A process cartridge according to the present embodiment includes: an image bearing member, which is rotatable and is configured to bear a developer image formed of developer; a developer bearing member, which is configured to be rotatable in a state in contact with the image bearing member in order to supply the developer to the image bearing member, for forming on a surface of the image bearing member; and a cleaning member (6) disposed in contact with the image bearing member, and configured to clean the surface of the image bearing member by scraping off the developer remaining on the surface of the image bearing member after the developer image is transferred from the image bearing member.

In the present embodiment, a fixation layer, including at least one of an organosilicon polymer and inorganic particles, is provided on a surface of the developer borne on the developer bearing member, and a fixation percentage of the fixation layer (40L) on the surface of the developer (45, 46) is 85% or greater. The image bearing member and the developer bearing member are rotationally driven such that, the surface of the image bearing member and a surface of the developer bearing member move in opposite directions from each other at a contact portion (117S) where the image bearing member and the developer bearing member are in contact with each other.

Note that the type of developer that can be used may be the first type (45) or may be the second type (46), as long as the fixation percentage of the fixation layer at the surface of the developer is 85% or greater. A mixture of the first and second types may be used.

As described above, in the present embodiment, a relation of 100%≤X≤250% can be satisfied, where X represents a ratio of rotation speed of the developer bearing member as to rotation speed of the image bearing member. Particularly, in the present embodiment, adjustment of the ratio of the rotation speed of the developer bearing member as to the rotation speed of the image bearing member can be performed by fixing the rotation speed of the image bearing member and changing the rotation speed of the developer bearing member. Thus, the ratio (difference) X of the peripheral speed can be changed more easily in image forming control.

Although an arrangement has been described in the present embodiment where the rotation speed of the photosensitive drum 1 is fixed and the rotation speed of the developing roller 17 is changed to adjust X, an arrangement may be made where the rotation speed of the developing roller 17 is fixed and the rotation speed of the photosensitive drum 1 is changed. Alternatively, the rotation speeds of both the photosensitive drum 1 and the developing roller 17 may be changed.

In the present embodiment, the fixation layer (40L) may include organosilicon polymer and inorganic particles. In particular, the fixation layer may be of a configuration (46*b*) integrally formed with each of the base particles (45*a*, 46*a*) of the developer by chemical bonding at a surface of each of the base particles of the developer. Alternatively, the fixation layer may be a configuration (45*b*) included in the developer as an external additive and physically adsorbed at a surface of each of the base particles of the developer.

In the present embodiment, the cleaning member (6) may have a blade member that comes into contact with the surface of the image bearing member, with a nip portion (16S) being formed between the surface of the image bearing member and the blade member. At least part (41) of the fixation layer (40L), provided on the surface of the developer, may peel away from the surface of the developer and move to the nip portion (16S), in conjunction with rotation operations of the developer bearing member and the image bearing member.

The developer in the present embodiment may be a non-magnetic one component developer.

A restricting member (21), which is configured to restrict an amount of developer borne on the developer bearing member may further be provided in the present embodiment.

The developing unit 4 of the process cartridge 7 according to the present embodiment may further include: a developing chamber (19*a*) configured to accommodate the developer bearing member; and a developer accommodating chamber (18*a*) configured to accommodate developer to be supplied to the developer bearing member, the developer accommodating chamber having an opening (19*b*) for communicating with the developing chamber. When in use, the developer accommodating chamber may be disposed below the developing chamber. The developer accommodating chamber may be provided with a conveying member configured to convey the developer to the developing chamber situated above.

In the present embodiment, the developing chamber may be provided with a supply member (20) configured to supply the developer to the developer bearing member by rotating in a state in contact with the developer bearing member. The developer bearing member and the supply member may be rotationally driven such that, the surface of the developer bearing member and a surface of the supply member move in opposite directions from each other at a contact portion (20S) where the developer bearing member and the supply member are in contact with each other.

The process cartridge according to the present embodiment may be detachably mountable to a main assembly of an image forming apparatus.

An image forming apparatus according to the present embodiment includes a process cartridge and a fixing device (10) configured to fix the developer image to a recording medium.

Although an image forming apparatus and process cartridge that forms color images has been exemplified in the present embodiment, the present disclosure is not restricted to this. For example, the present disclosure is also applicable to an image forming apparatus that forms monochromatic images using a non-magnetic one component toner, which can yield the same advantages.

Also, an example has been described in the present embodiment where the toner supply roller 20 and developing roller 17 are rotated in the same rotation direction so that the surfaces thereof move in opposite directions at a facing portion (contact portion 20S), the present disclosure is not restricted to this. For example, the toner supply roller 20 and developing roller 17 may be rotated in different rotation directions so that the surfaces thereof move in the same direction at the facing portion. Alternatively, a configuration may be made where no toner supply roller 20 is provided. Advantages the same as those of the present embodiment may be obtained in these cases as well.

Also, an example has been described in the present embodiment where the image forming apparatus is a printer, but the present disclosure is not restricted to this. For example, the present disclosure is applicable to other image forming apparatus such as a photocopier, a facsimile device, a multi-function peripheral where these functions have been combined, and so forth.

Also, an example has been described in the present embodiment where the developer of the first type (45) or the developer of the second type (46) is used for image forming operations, as described above, an arrangement where the developers of the first type and second type have been mixed may be used for image forming operations.

As described above, a process cartridge and an image forming apparatus according to the present disclosure improves cleaning performance of the image bearing member, while improving developing endurance of the developer.

Also, the process cartridge and image forming apparatus according to the present disclosure can increase the amount of toner falling particles (41) that migrates to the photosensitive drum with a simple configuration, with toner having excellent developing endurance (e.g., developer of the second type). Accordingly, a "prevention layer (41)" can be effectively formed at the nip portion (16S) between the photosensitive drum and cleaning member, so toner can be suppressed from slipping through.

That is to say, even in a case of using toner having a higher fixation percentage (e.g., developer of the second type), there is little deterioration of cleaning performance of the cleaning member (6) in the process cartridge and image forming apparatus according to the present disclosure. Thus, a configuration where there is little developer that slips through to the downstream side from the cleaning member can be realized.

According to the present disclosure, cleaning performance of the image bearing member can be improved while improving developing endurance of the developer.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-110475 filed Jun. 8, 2018, which is hereby incorporated by reference herein in its entirety.

What is claimed is:

1. A process cartridge, comprising:

an image bearing member, which is rotatable and is configured to bear a developer image formed of developer;

a developer bearing member, which is configured to be rotatable in a state in contact with the image bearing member in order to supply the developer to the image bearing member, for forming the developer image on a surface of the image bearing member; and a cleaning member disposed in contact with the image bearing member and configured to clean the surface of the image bearing member by scraping off the developer remaining on the surface of the image bearing member after the developer image is transferred from the image bearing member, wherein a fixation layer, including an organosilicon polymer is integrally formed with base particles of the developer borne on the developer bearing member by chemical bonding at a surface of the base particles of the developer, and a fixation percentage of the fixation layer on the surface of the developer is 85% or greater, and wherein the image bearing member and the developer bearing member are rotationally driven such that, the surface of the image bearing member and a surface of the developer bearing member move in opposite directions from each other at a contact portion where the image bearing member and the developer bearing member are in contact with each other.

2. The process cartridge according to claim 1, wherein a relation of $100\% \leq X \leq 250\%$ is satisfied, where X represents a ratio of rotation speed of the developer bearing member as to rotation speed of the image bearing member.

3. The process cartridge according to claim 2, wherein adjustment of the ratio of the rotation speed of the developer bearing member as to the rotation speed of the image bearing member is performed by fixing the rotation speed of the image bearing member and changing the rotation speed of the developer bearing member.

4. The process cartridge according to claim 1, wherein the fixation layer includes the organosilicon polymer and inorganic particles.

5. The process cartridge according to claim 1, wherein the cleaning member has a blade member that comes into contact with the surface of the image bearing member, with a nip portion being formed between the surface of the image bearing member and the blade member, and wherein at least part of the fixation layer, provided on the surface of the developer, peels away from the surface of the developer and moves to the nip portion, in conjunction with rotation operations of the developer bearing member and the image bearing member.

6. The process cartridge according to claim 1, wherein the developer is a non-magnetic one component developer.

7. The process cartridge according to claim 1, further comprising:

a restricting member, which is configured to restrict an amount of developer borne on the developer bearing member.

8. The process cartridge according to claim 1, further comprising:

a developing chamber configured to accommodate the developer bearing member; and a developer accommodating chamber configured to accommodate developer to be supplied to the developer bearing member, the developer accommodating chamber having an opening for communicating with the developing chamber, wherein, when in use, the developer accommodating chamber is disposed below the developing chamber, and wherein the developer accommodating chamber is provided with a conveying member configured to convey the developer to the developing chamber situated above.

9. The process cartridge according to claim 8, wherein the developing chamber is provided with a supply member configured to supply the developer to the developer bearing member by rotating in a state in contact with the developer bearing member, and wherein the developer bearing member and the supply member are rotationally driven such that, the surface of the developer bearing member and a surface of the supply member move in opposite directions from each other at a contact portion where the developer bearing member and the supply member are in contact with each other.

10. The process cartridge according to claim 1, wherein the process cartridge is detachably mountable to a main assembly of an image forming apparatus.

11. An image forming apparatus, comprising:

a process cartridge, including an image bearing member, which is rotatable and is configured to bear a developer image formed of developer;

a developer bearing member, which is configured to be rotatable in a state in contact with the image bearing member in order to supply the developer to the image bearing member, for forming the developer image on a surface of the image bearing member; and a cleaning member disposed in contact with the image bearing member and configured to clean the surface of the image bearing member by scraping off the developer remaining on the surface of the image bearing member after the developer image is transferred from the image bearing member, wherein a fixation layer, including an organosilicon polymer is integrally formed with base particles of the developer borne on the developer bearing member by chemical bonding at a surface of the base particles of the developer, and a fixation percentage of the fixation layer on the surface of the developer is 85% or greater, and wherein the image bearing member and the developer bearing member are rotationally driven such that, the surface of the image bearing member and a surface of the developer bearing member move in opposite directions from each other at a contact portion where the image bearing member and the developer bearing member are in contact with each other; and a fixing device configured to fix the developer image to a recording medium.

* * * * *